US007401951B2

(12) United States Patent
Burton, Jr.

(10) Patent No.: US 7,401,951 B2
(45) Date of Patent: Jul. 22, 2008

(54) LIGHT SHIELD

(76) Inventor: Hubert Carl Burton, Jr., 104 Quail Creek La., Greenville, SC (US) 29615

( * ) Notice: Subject to any disclaimer, the term of this patent is extended or adjusted under 35 U.S.C. 154(b) by 122 days.

(21) Appl. No.: 10/630,425

(22) Filed: Jul. 30, 2003

(65) Prior Publication Data

US 2005/0013137 A1 Jan. 20, 2005

Related U.S. Application Data

(63) Continuation-in-part of application No. 10/619,339, filed on Jul. 14, 2003, now abandoned.

(51) Int. Cl.
*F21S 8/00* (2006.01)

(52) U.S. Cl. ..... 362/431; 362/351; 362/361; 362/359; 362/347

(58) Field of Classification Search ..... 362/414, 362/431, 351, 361, 359, 362, 368, 341, 342, 362/343, 344, 347, 349, 354, 554, 551, 556, 362/26, 410; 385/123, 129, 131, 901; D26/67, D26/68

See application file for complete search history.

(56) References Cited

U.S. PATENT DOCUMENTS

| | | | | |
|---|---|---|---|---|
| 473,240 | A * | 4/1892 | Seavey | 362/349 |
| D024,473 | S | 7/1895 | McFaddin | D26/125 |
| 2,522,230 | A | 9/1950 | Komulaine | 240/36 |
| D166,031 | S | 2/1952 | Douglas | D29/1 |
| D166,177 | S | 3/1952 | De Sherbinin | D48/20 |
| 2,665,373 | A | 1/1954 | Rashke | 240/105 |
| 3,412,561 | A | 11/1968 | Reid | 61/35 |
| 3,666,935 | A | 5/1972 | Prichett et al. | 240/1.2 |
| 3,895,227 | A | 7/1975 | Murray et al. | 240/73 |
| 3,919,542 | A | 11/1975 | Castic | 240/41.55 |
| 3,933,311 | A | 1/1976 | Lemelson | 239/276 |
| 4,228,489 | A | 10/1980 | Martin | 362/250 |
| 4,272,799 | A | 6/1981 | Downing | 362/145 |
| D286,989 | S | 12/1986 | Akiyama et al. | D10/114 |
| 4,725,934 | A * | 2/1988 | Gordin | 362/298 |
| 4,807,100 | A | 2/1989 | Hudimac, Jr. | 362/255 |
| 4,866,582 | A | 9/1989 | Osteen et al. | 362/359 |

(Continued)

OTHER PUBLICATIONS

Light Shields & Modifications, (darksky.org/~ida/fixtures/mods.html), last updated May 21, 2003.

(Continued)

*Primary Examiner*—Thomas M. Sember
(74) *Attorney, Agent, or Firm*—Nelson Mullins Riley & Scarborough

(57) ABSTRACT

The present invention is directed to a light housing installed in close proximity to a light source. The light housing has a shield and an attachment arm for securing the shield. The attachment arm allows the shield to be removably attached in close proximity to the light source. The housing optionally has an aperture allowing the housing to be installed over and/or around the light source. The housing at least partially blocks light emanating from a light source, such as an in-ground staked floodlight, and keeps the light from shining directly into the eyes of a person observing the light source. The housing also hides the unsightly components of a light source.

17 Claims, 5 Drawing Sheets

U.S. PATENT DOCUMENTS

| | | | | | |
|---|---|---|---|---|---|
| 4,868,727 | A | | 9/1989 | Ponds et al. | 362/344 |
| 4,951,184 | A | | 8/1990 | Makurof | 362/362 |
| D311,597 | S | | 10/1990 | Poot | D26/118 |
| 5,003,439 | A | | 3/1991 | Yang | 362/153 |
| 5,055,987 | A | | 10/1991 | Ellson et al. | 362/277 |
| 5,158,348 | A | | 10/1992 | Sakamoto et al. | 362/19 |
| 5,274,534 | A | | 12/1993 | Armstrong | 362/249 |
| 5,280,417 | A | | 1/1994 | Hall et al. | 362/226 |
| 5,335,149 | A | | 8/1994 | Evans | 362/61 |
| 5,398,180 | A | | 3/1995 | Lee | 362/431 |
| 5,570,952 | A | | 11/1996 | Protz, Jr. | 362/431 |
| 5,599,091 | A | * | 2/1997 | Kira | 362/269 |
| 5,649,760 | A | * | 7/1997 | Beadle | 362/270 |
| 5,651,606 | A | * | 7/1997 | Krogman | 362/96 |
| D394,728 | S | | 5/1998 | Alexander | D26/118 |
| 5,788,361 | A | * | 8/1998 | Lee | 362/249 |
| 5,803,594 | A | * | 9/1998 | Fredrickson et al. | 362/351 |
| D400,289 | S | | 10/1998 | Wardenburg et al. | D26/118 |
| 5,890,797 | A | | 4/1999 | Bish | 362/419 |
| 6,164,273 | A | * | 12/2000 | Waters | 126/92 B |
| 6,176,595 | B1 | * | 1/2001 | Bomas | 362/241 |
| 6,183,112 | B1 | * | 2/2001 | Bomas | 362/285 |
| 6,386,729 | B1 | * | 5/2002 | Bober | 362/431 |
| 6,422,709 | B1 | | 7/2002 | Panagiotou | 362/16 |
| D463,061 | S | * | 9/2002 | Ludwig | D26/118 |
| 6,461,018 | B1 | | 10/2002 | Chanslor | 362/249 |
| D467,026 | S | | 12/2002 | Parker | D26/118 |
| 6,520,665 | B1 | | 2/2003 | Scandle | 362/431 |
| 6,543,905 | B1 | | 4/2003 | Adams et al. | 362/122 |
| 6,550,937 | B2 | | 4/2003 | Glass | 362/290 |
| 6,568,826 | B1 | | 5/2003 | Kotovsky | 362/147 |
| 2004/0095772 | A1 | * | 5/2004 | Hoover et al. | 362/363 |

OTHER PUBLICATIONS

LiPAW Outdoor Shielding Techniques—PAR Floodlights, Reducing Light Pollution on Your Property, (members.aol.com/ctstarwchr/PARshield.html), last updated Dec. 5, 2001.

Kim Lighting Catalog pp 1-2 aquanlite.com/store/page26.html).

Advertisement by Steelcase Inc. entitled Canopy. Online at http://www.steelcase.com/servlet/productServlet.

* cited by examiner

LIGHT SHIELD

CROSS-REFERENCE TO RELATED APPLICATIONS

This application is a continuation-in-part of U.S. patent application Ser. No. 10/619,339, filed Jul. 14, 2003, now abandoned and claims the priority benefit of that application, which is incorporated by reference herein in its entirety.

BACKGROUND OF THE INVENTION

1. Field of the Invention

The present invention relates generally to a light housing, and in particular, to a light housing installed in close proximity to a light source for reducing the visible glare associated with conventional lighting and for preventing the mechanical components of a light source from being noticed by an observer.

2. Description of the Related Art

There are many different types of ground-level outdoor lighting fixtures in use today. Well known ground-level outdoor lighting fixtures include, for example, floodlights and low voltage lights.

In the landscaping industry, decorative low voltage lights are commonly designed with stakes for inserting into the ground. These low voltage lights typically contain light bulbs of low-wattage and are thus, not designed to provide high intensity illumination. Instead, low voltage lights are most often staked out along patios and driveways to decoratively illuminate the desired path.

High intensity floodlights are also well known and, unlike low voltage lighting, are commonly used to brightly illuminate a large open area. Floodlights have been traditionally designed for mounting at a height, such as to a wall, roof corner, or privacy fence, to light up a patio, pool, or yard. Unlike low voltage lighting, floodlights have not been typically used for decorative lighting. Recently, however, it has been recognized that there are advantages associated with brightly illuminating large natural features, such as trees, shrubs, and decorative ponds and waterfalls. As a result, floodlights have now been specifically designed for staking into the ground to act as a touch of nighttime landscaping decoration or to highlight certain targets.

Unfortunately, when these high intensity ground-level floodlights are aimed at the target to be illuminated, many problems can arise.

One potential problem with high intensity ground-level floodlights is excessive glare. Glare is often present when a person looks directly toward the source of the light. Glare can be from direct or indirect routes and can result in unwanted visual discomfort caused by excessive brightness.

Excessive spill light is also a problem for high intensity ground-level floodlights. Spill light is the light that illuminates surfaces beyond the area intended to be illuminated. A potentially more harmful form of spill lighting is light trespass. Light trespass is light emitted by a lighting installation that falls outside the boundaries of the property on which the light installation is sited. Light trespass is particularly important to prevent given the increasing recognition that allowing a high intensity floodlight to shine on your neighbor's window or yard is a nuisance and in some areas considered a violation of light trespass ordinances.

Yet another problem is that observing the visible floodlight fixture itself can detract from the overall ambience of the illuminated target. For example, a decorative pond or waterfall can create a natural and relaxing feeling for an observer.

If the decorative pond or waterfall is illuminated, then being able to see the floodlight itself can detract from the pleasing effect of the natural setting. Similarly, outdoor Christmas decorations are sometimes illuminated with a ground-level floodlight. If an observer notices the floodlight components, it can detract from the overall Christmas scene.

While ground-level floodlights with light shields directly attached to the floodlight itself have been used, they are costly and also incompatible with staked ground-level floodlights that do not have attached light shielding. Moreover, having a ground-level floodlight with a preattached light shield eliminates the option of easily removing the light shield should the user so desire. Most floodlights with preattached shields also suffer from the problem of an observer noticing the floodlight components instead of having them blend into the natural setting.

U.S. Pat. No. 2,522,230 to Komulaine discloses a light fixture having an open front structure having pairs of diverging walls and a conventional socket for mounting an incandescent lamp. The lamp is inserted through the apertures in the back of the light fixture and is secured by a nut and clamps. The lamp has a top to the housing. The light fixture of this patent is capable of being folded substantially flat and the light removed. Komulaine does not teach a housing that is completely detached and removable from the light source. Also, Komulaine does not disclose the use of stakes to insert the light fixture into the ground.

U.S. Design Pat. No. 166,177 to Sherbinin discloses a television lamp ornamental design. The Sherbinin lamp does not disclose a housing with a top and an opening. The Sherbinin lamp also fails to disclose at least one stake for removably inserting it into the ground.

U.S. Pat. No. 4,807,100 to Hudimac discloses a light director having an elongated, opaque open-ended shield that slips over the light bulb. Hudimac also discloses that a plurality of flat, spaced apart slats extend across one open end and function to cause the light to exit in parallel beams. The light housing is disclosed as a rectangular box. However, Hudimac does not disclose the use of stakes to secure the light fixture. Also, Hudimac does not disclose an arch-shaped opening in the housing allowing the housing to be installed over the light source.

U.S. Pat. No. 4,868,727 to Ponds, et al. (Ponds) discloses a lighting fixture including a housing for accommodating an elongated lamp bulb parallel to the window opening. The elongated lamb bulb is attached to the light fixture through either one or two connections, depending on the type of bulb used. Thus, Ponds does not disclose a removable light housing completely detached and removable from the light source. Ponds does not disclose the use of a stake to insert and secure the light fixture to the ground.

U.S. Design Pat. No. 311,697 to Poot discloses a reflector for lamps. As shown in the figures, the reflector has an arch-shaped slot to fit around the light source in the base of the reflector. Also, all sides of the reflector are straight. However, Poot does not disclose an arch-shaped opening in the housing, opposed to the base of the housing, enabling it to fit over the light source. Also, Poot does not disclose a curved housing or the use of a stake to insert the light fixture into the ground.

U.S. Pat. No. 5,055,987 to Ellson, et al. (Ellson) discloses a light fixture with a bulb/lens assembly having a transparent lens with a cylindrical wall mounted atop a post. This patent is directed toward vertical or "downlighting" type of light fixtures. However, Ellson does not disclose a light fixture that is removable and detached from the light source. Also, the light fixture in Ellson completely encompasses the bulb and directs the light downward, as opposed to only covering about half the bulb as to direct the light whichever direction the light fixture is pointed.

U.S. Pat. No. 5,398,180 to Lee discloses a temple light mounted on a stake with a bulb receiver integrally formed on the upper side of the bottom of the lens. The light fixture is cylindrical and encompasses the bulb completely. However, Lee does not teach a light fixture that is removable and detached from the light source. Also, the light fixture in Lee completely encompasses the bulb and directs the light downward. Lee does not teach a light housing that rests in close proximity to the light source and can shield the light from an observer looking from behind the light source.

U.S. Pat. No. 5,584,574 to Haddad discloses an adjustable flood light fixture suitable for outdoor use, which can prevent unwanted glare through the use of a truncated cone shroud, which can be rotated 360°. Haddad does not disclose a stake for removably inserting a housing into the ground. Thus, Haddad attaches the housing directly to the light source.

U.S. Pat. No. 5,655,829 to Lin, et al. (Lin) discloses a floodlight assembly that holds multiple light sources and is capable of independently adjusting the direction of each light source. Lin also discloses one stake for removably inserting the assembly into the ground. However, Lin does not disclose a housing for shielding the light sources.

U.S. Design Pat. No. 394,728 to Alexander discloses a curved lampshade with sticks. The drawings disclose that the lampshade curves around the light source, but there is not an enclosed top covering the light source. Also, the lampshade is secured by stakes protruding down from the bottom of the lampshade. However, Alexander does not disclose an arch-shaped opening in the housing allowing the housing to be installed over the light source. Also, Alexander does not disclose that the lampshade has a top.

U.S. Design Pat. No. 400,289 to Wardenburg, et al. (Wardenburg) discloses a reflector for horticultural lighting. From the drawings, it can be seen that the reflector has a slot in the base wherein the light is inserted through the base. Also, the backside of the reflector is straight. However, Wardenburg does not disclose a curved shield or an arch-shaped opening in the housing allowing the housing to be installed over the light source. Also, Wardenburg does not disclose the use of a stake to secure the light fixture.

U.S. Pat. No. 6,422,709 to Panagiotou discloses a combination light assembly including a housing having a rear wall, which curves rearwardly from an upper straight edge and downwardly to a lower straight edge. The assembly also includes a light source, which is longitudinally mounted within a casing that is attachable to the housing. The light emitted from the light source passes through a lower opening in the housing and is reflected out of the housing for indirect illumination. However, Panagiotou does not disclose an arch-shaped opening in the shield allowing the housing to be installed over the light source. Also, Panagiotou does not disclose the use of a stake to secure the light fixture.

U.S. Design Pat. No. 463,061 to Ludwig discloses a lighting apparatus that, from the drawings, is angled at about a forty-five (45) degrees from vertical with a curved top. Thus, the curved nature of the design will direct light downward. The lighting apparatus is positioned with two downward poles. However, Ludwig does not disclose an arch-shaped opening in the shield allowing the housing to be installed over the light source. The apparatus disclosed by Ludwig is curved in a downward direction as opposed to being curved from side to side.

Therefore, what has been missing is a way to shield a ground-level floodlight or similar light source from an observer's line of sight without using a preattached light shield. What has also been missing is a way to enhance existing ground-level floodlights with a light shield that is both economical and visually pleasing, yet remains technologically uncomplicated.

SUMMARY OF THE INVENTION

Briefly, therefore, the present invention is directed to a light housing that is secured in close proximity or is attached directly to a light source. The light housing comprises a shield and at least one attachment arm for securing the shield. The attachment arm allows the shield to be removably or permanently attached to a fixed object, such as, for example, into the ground that is in close proximity to the light source or the attachment arm allows the shield to be removably or permanently attached to the light source itself. The shield acts as at least a partial block between the light source and a viewer observing from a point where the housing is located between the viewer and the light source. The housing can optionally have an aperture in the shield allowing the housing to be installed over and/or around the light source. The shield also optionally comprises a top to further block illumination from the light source.

The shield at least partially blocks light emanating from a light source, such as an in-ground staked floodlight, and helps keep the light from shining directly into the eyes of a person observing the light source where the shield is located between the person viewing and the light source. Thus, the overall effect of the housing is to at least partially shield the eyes of a person observing the light source from direct illumination by the light source.

The present invention is directed to a portable light housing for shielding a light source from a viewer, comprising a shield having a rear wall located between the light source and the viewer, wherein the rear wall has a top edge and a bottom edge, and is formed to partially enclose the light source; an optional top that is attached to the top edge and at least partially covers that portion of the shield which encloses the light source; an optional aperture for removably inserting the light source; and at least one attachment arm for attaching the shield to a fixed object.

Among the several advantages found to be achieved by the present invention, therefore, may be noted the provision of a way to shield a ground-level floodlight or similar light source from an observer's line of sight by using a light shield. The present invention also provides the advantage of enhancing existing ground-level floodlights with a light shield that is both economical and visually pleasing, yet remains technologically uncomplicated.

DETAILED DESCRIPTION OF THE PREFERRED EMBODIMENTS

It should be understood that the following description of the preferred embodiments is merely exemplary in nature and is in no way intended to limit the invention or its applications or uses. Modifications and variations of the present invention will readily occur to those skilled in the art.

Figure 2:
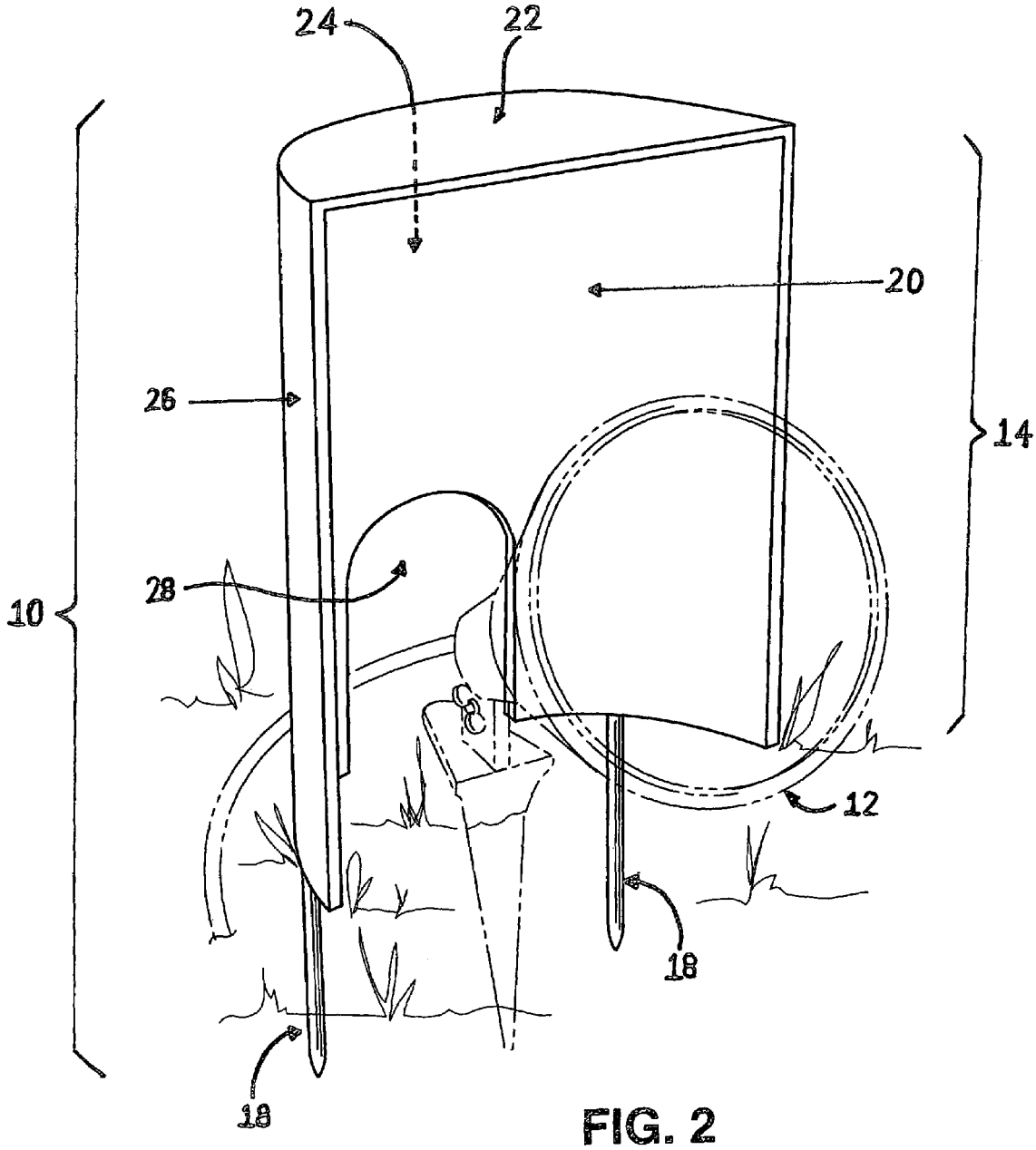
FIG. 2 is a front view that shows the light housing an embodiment of the present invention located behind an outlined ground-level floodlight.

For purposes of the following description, the terms "upper," "lower," "left," "rear," "front," "vertical," "horizontal" and derivatives of such terms shall relate to the invention as oriented in FIG. 2. However, it is to be understood that the invention may assume various alternative orientations, except where expressly specified to the contrary. It is also to be understood that the specific devices illustrated in the attached drawings, and described in the following specification are simply exemplary embodiments of the inventive concepts defined in the appended claims. Specific dimensions and other physical characteristics relating to the embodiments disclosed herein are not to be considered as limiting, unless the claims expressly state otherwise.

Figure 5:
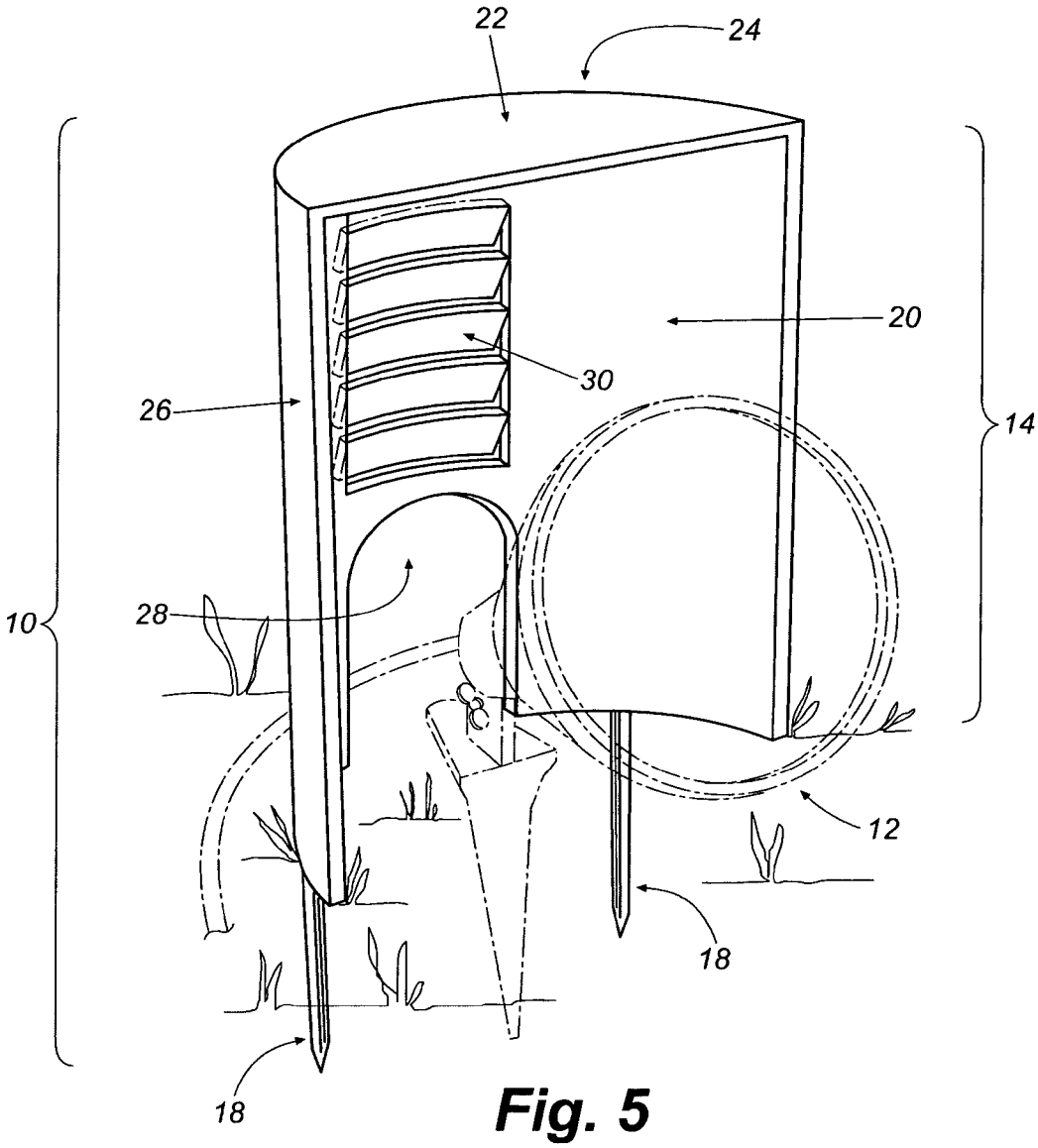

FIG. 5 is a rear view that shows the rear wall, aperture, top sidewalls, attachment arm and louvers of the light housing of one embodiment of the present invention.

In accordance with the present invention, it has been discovered that when the light housing of the present invention is installed in close proximity to a light source, such as a ground-level floodlight, it is an effective shield between an observer and the light source. The housing also at least partially blocks light emanating from the light source and keeps the light from shining directly into the eyes of a person observing the light source.

Figure 1:
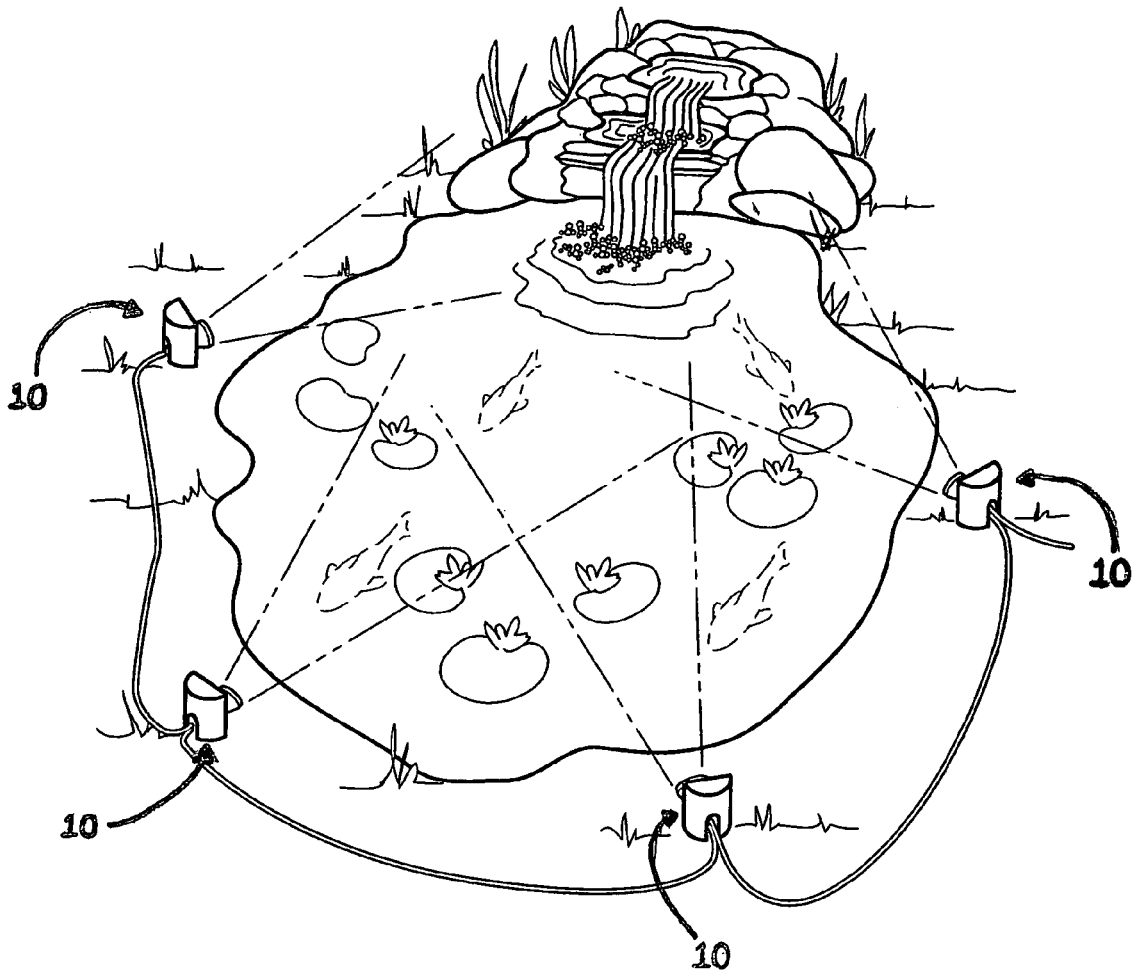
FIG. 1 is a perspective view that shows multiple light housings of one embodiment of the present invention located in close proximity to multiple ground-level floodlights arranged concentrically around a decorative pond and waterfall.

Referring now to the drawings, in which corresponding parts are identified with the same reference numeral, and more particularly to one embodiment of the light housing of the present invention depicted as FIG. 1, in which multiple light housings 10 are placed in close proximity to a decorative waterfall and pond for preventing an observer from noticing the ground-level floodlight components, thus adding to the overall effect of an illuminated object when in or near a natural setting.

Referring now to FIG. 2, the light housing 10 of one embodiment of the present invention comprises two general components, a shield 14 and at least one attachment arm 18.

The shield 14 includes an interior portion 20, an optional top 22, a rear wall 24, at least one optional side wall 26, and optionally, an aperture 28 in the rear wall 24 of the shield 14 for removably inserting a light source 12. Also shown in FIG. 2 in outline form, is the light source 12. In the case of FIG. 2, the light source 12 in outline form is a ground-level floodlight with a plastic stake for removably inserting the floodlight (e.g. the light source) into the ground.

The light housing 10 of FIG. 2 has at least one attachment arm 18, which allows it to be removably inserted into the ground, attached to the same structure as the light source, attached to the light source itself, or attached to some other suitable stabilizing structure. The attachment arm 18 keeps the light housing 10 stabilized in close proximity thereto or directly attached to the light source 12 during adverse weather or when an observer or pets walk nearby.

In one embodiment of the present invention, the attachment arm 18 is directly attached to the bottom edge of the rear wall 24 and functions to attach the light housing to the light source itself or attaches the light housing to the ground in close proximity to the light source.

In one embodiment, the attachment arm 18 removably attaches the light housing to a suitable fixed object, such as the ground or to a component of the light source itself, in a non-permanent manner so that the light housing may be easily unattached and then later reattached if a user so desires. Alternatively, in other embodiments, the attachment arm 18 permanently attaches the light housing to any fixed object.

The attachment arm 18 can be selected from one or more devices, including, but not limited to, glue, screws, clamps, staples, nails, stakes (plastic, metal, or wood), screws, clamps, tie downs (string or cord), Velcro®, tape, wire ties, buttons, snaps, weights, hooks, metal rods, or magnetic attachments, or any other suitable device for attaching the shield 14 to a fixed object.

In other embodiments, the attachment arm 18 is injection molded as a unitary construction contiguous with the shield 14.

The attachment arm 18 may attach, insert or secure the shield 14 to one or more locations, including, but not limited to, a deck, ground, the light source itself, trees, and the wall of a house or metal pole.

In one embodiment of the present invention, the attachment arm 18 attaches the shield 14 onto or into the ground. The ground may be any support surface capable of receiving the attachment arm 18, such as dirt, grass, gravel, garden areas, concrete, wood, or a permeable material such as foam.

In another embodiment, the attachment arm 18 attaches the shield 14 onto any component thereon and at any position of the light source itself. One suitable position would be wherein the housing is attached directly to the same light source component that removably receives the light bulb of the light source.

Figure 3:
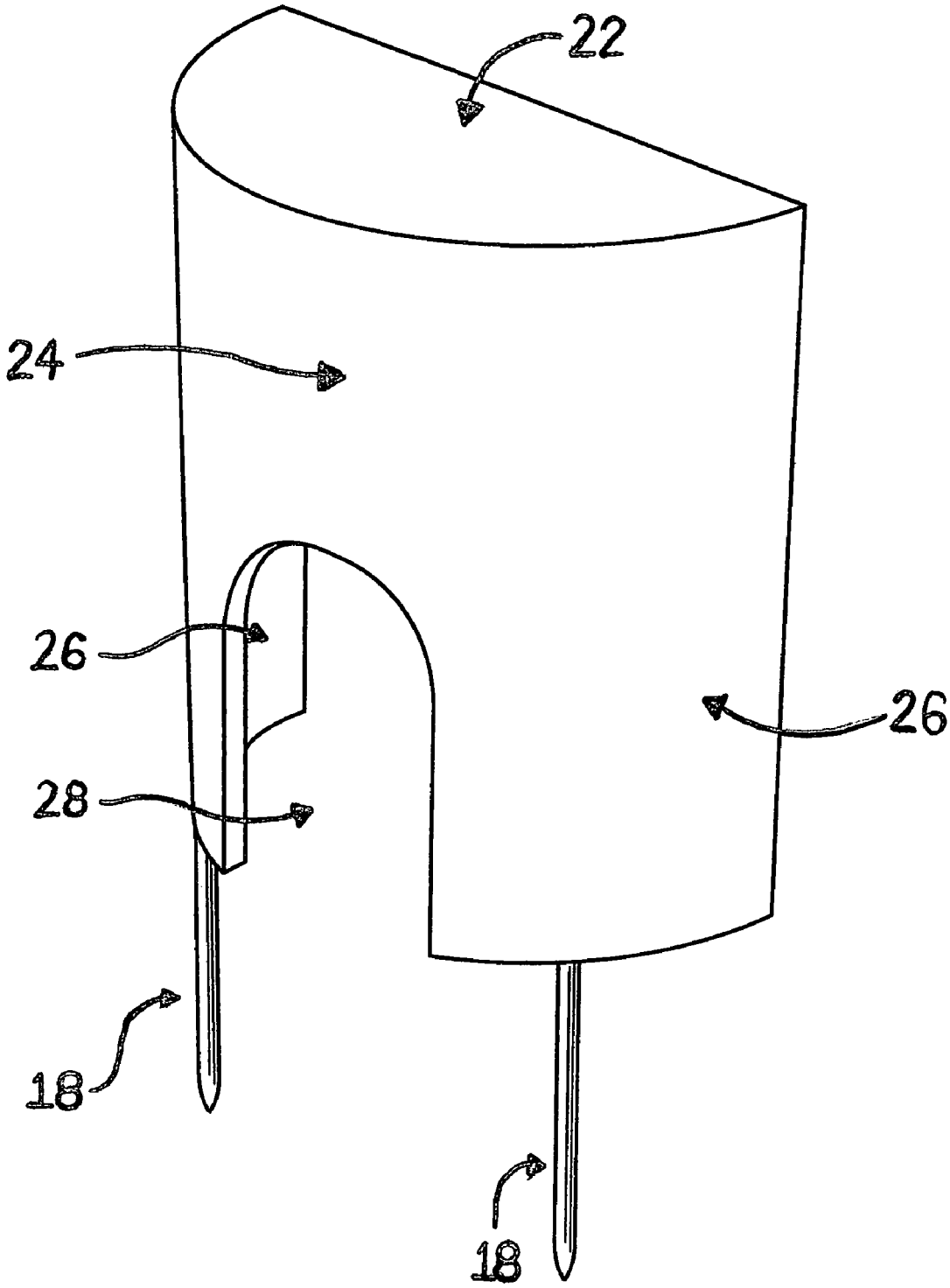
FIG. 3 is a rear view that shows the rear wall, aperture, top, sidewalls, and attachment arm of the light housing of one embodiment of the present invention.
Figure 4:
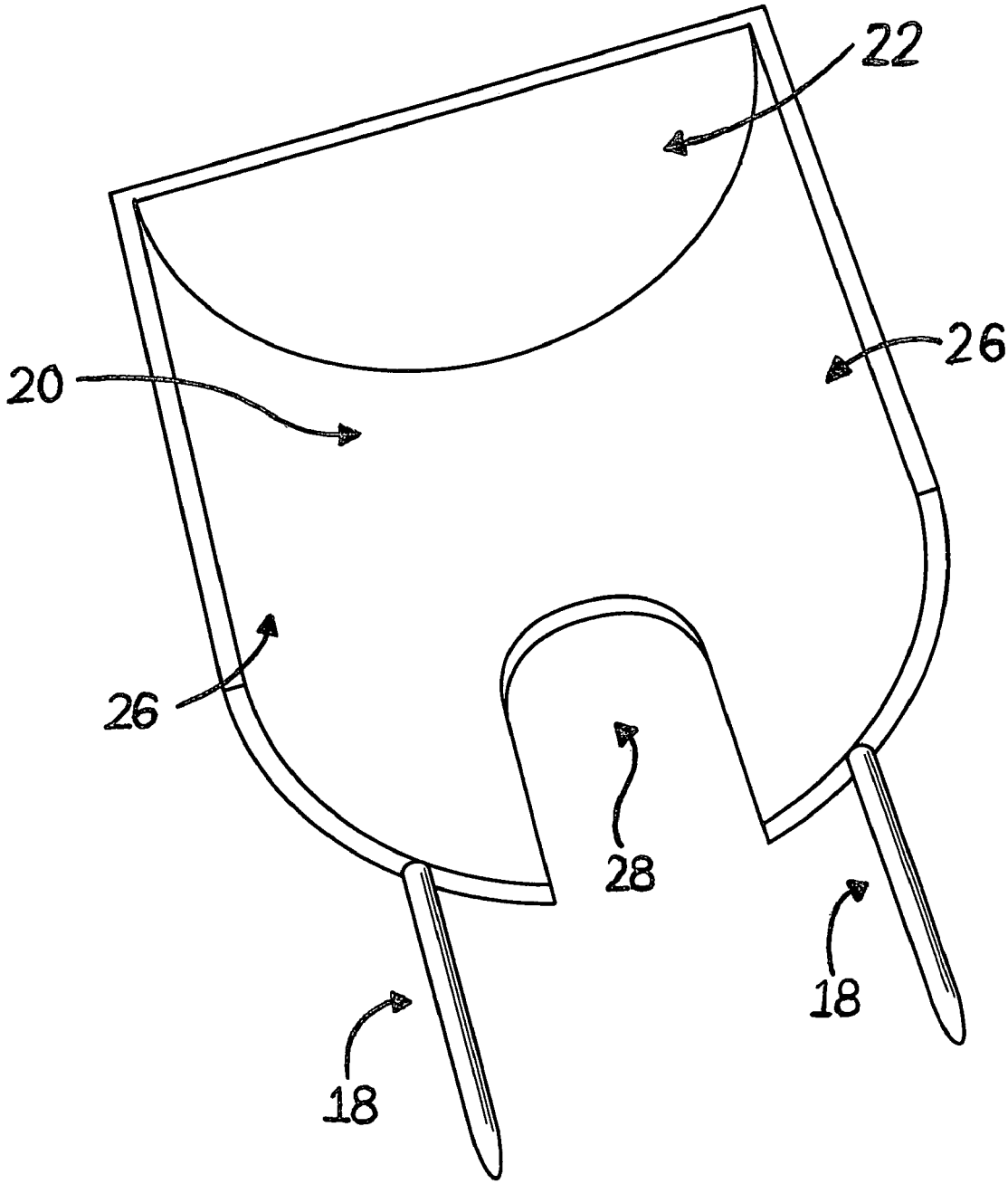
FIG. 4 is a front view that shows the interior portion of the shield, aperture, attachment arm, top and sidewalls of the light housing of one embodiment of the present invention.

Referring now to FIGS. 3 and 4, the attachment arm 18 comprises one or more stakes, and in one embodiment, the stakes are metal stakes with a sharpened end. Such stakes may take any shape and may be constructed of any material that is suitable for allowing the stake to be inserted into the ground in a secure fashion. The stakes can be constructed from various high impact, weather and ultraviolet light resistant polymers and from such metals as stainless steel and aluminum. The stake preferably has a pointed tip to ease insertion into the ground. The stake may also have an "X" shaped cross-section to provide strength while inserted into the ground. The stakes can be any length necessary to removably insert the shield into the ground, and in one embodiment, the stakes are between about 1 inch and about 6 inches in length.

Referring now to FIG. 2, the light housing 10 further comprises at least one optional aperture 28 in the shield 14 allowing the housing 10 to be installed over and/or around the light source 12 or the electrical cord of the light source. However, the aperture is entirely optional and not necessarily required for use with some embodiments of the present invention.

In one embodiment, the optional aperture 28 can be a circular opening in the rear wall 24 of the shield 14, which is large enough to permit the light source 12 and/or the electrical cord of the light source to pass through. The aperture 28 can also be an arch-shaped opening that is large enough to permit at least some portion of the light source 12 to be inserted into. Referring now to FIG. 3, the arch-shaped aperture 28 is, in one embodiment, open and contiguous with the bottom edge of the rear wall 24. Thus, as depicted in FIG. 2, the light housing 10 is capable of being removably slid over a light source 12 through the arch-shaped aperture 28. The aperture may contact or touch the light source in some embodiments or it may be entirely separate from the light source.

In still other embodiments, the aperture 28 can be lined with, or have attached thereto, one or more plastic or rubber flaps, or any other suitable material that may extend as far as expedient to the opposite sides of the aperture 28 in order to facilitate additional blockage of the visibility of the light source. In one embodiment, the flap may be a unitary structure that entirely covers the aperture 28, except for a narrow slit or hole, which allows for removable insertion of the light source or the light source electrical cord.

In yet additional embodiments, the light housing 10 can optionally have a first aperture 28 that is open and continuous with the bottom edge of the rear wall 24 and an optional second aperture 28 that is open and continuous with the top edge of the rear wall 24. In certain embodiments, the second aperture 28 is the only aperture that is present.

The second aperture may be configured in such a way as to receive an insert unit. The insert unit may be a plastic insert unit that is tinted with one or more solid colors or has a decorative and/or holiday-specific design. The insert unit is configured to be readily removed or inserted into the second aperture should a user of the light housing so desire. For example, a user may desire to swap out or exchange holiday-specific insert units depending upon any given holiday season.

The light housing 10 also comprises an optional top 22 to block the visibility of the light source 12 from an observer. Referring now to FIGS. 2 and 3, the optional top 22 extends from the top edge of the rear wall 24 of the shield 14 to the ends of an optional sidewall 26.

In one embodiment, the top is flat and extends perpendicularly at a 90° angle from the rear wall 24. In other embodiments, the top can extend from the rear wall 24 at angles greater or less than 90°. For example, at angles of greater than 90°, the light housing directs or focuses the light source at a higher angle and onto a tall object, such as a tree. Likewise, at angles less than 90°, the light housing directs or focuses the light source at a lower angle onto short objects such as a pond or ground cover, etc.

In some embodiments, the top 22 may extend past the end of the sidewall 26. The top 22 may be formed of the same material as the shield 14 and may be a one-piece unitary construction with the shield 14. Furthermore, the top 22 may be a flat, domed, or conically shaped structure. In other embodiments, the top 22 is a structure having a decorative design. Any shaped structure is suitable, as long as the top functions to at least partially block the visibility of the light source from an observer looking at the light source.

Referring now to FIGS. 2 and 3, the light housing 10 also has a rear wall 24 and at least one optional sidewall 26. In one embodiment, the rear wall 24 extends from and connects the top 22 of the light housing 10 to the attachment arm 18. The rear wall 24 alone or including the optional sidewall 26 may be any shape that functions to block the visibility of the light source 12 from an observer looking from behind the light house 10, including, such shapes as flat, round, curved, semi-circular, convex, concave, square, rectangular, or combinations or partial combinations thereof, etc. The sidewalls can extend from the rear wall 24 to as far as necessary to block the visibility of the light source components. In one embodiment, the sidewalls do not substantially wrap around the light source. In other embodiments, the sidewalls extend and wrap the entire distance around the light source. Thus, in certain embodiments, the sidewalls 26 may extend as far outward from the rear wall 24 or as far around the light source as expedient.

In another embodiment, the rear wall 24 and sidewalls 26 are configured in the shape of specific decorative design, namely a holiday-specific decorative design. For example, the shield 14 may be designed in the shape of a Jack-O-Lantern for Halloween, a wreath or Christmas tree for Christmas, or a rabbit for Easter.

Referring now to FIGS. 3 and 4, in another embodiment, the rear wall 24 is semi-circular and is adjoined on each of its two horizontal ends by two sidewalls 26 which are curved and substantially match the same radius as the semi-circular rear wall 24, so that the two curved sidewalls are contiguous with the semi-circular rear wall and together form a uniform semi-circular shape.

The light housing 10 may be constructed from any suitable material, as long as the materials are sufficiently opaque to at least partially block the visibility of the light source 12 from an observer looking at the light source 12 from the rear. For example, the light housing 10, which includes all the components of an optional top 22, a rear wall 24, an optional side wall 26, and at least one attachment arm 18, may be constructed from any suitable metal, plastic (e.g. thermosetting or thermoplastic), composite material or cellulosic material, or mixtures thereof.

The attachment arm 18 can be made of the same material as the rest of the light housing 10 or the attachment arm 18 may be constructed from a different material. Suitable materials for constructing the attachment arm 18 include, for example, metal materials, such as steel, aluminum, or iron alloys, thermoplastic and thermoset polymers, composite materials, and cellulosic materials.

As used herein, the term "thermosetting polymer" means a crosslinked polymer which does not flow when heated; once set at a temperature critical for a given material, a thermosetting polymer cannot be resoftened and reworked. Examples of thermosetting polymers include, by way of illustration only, alkyd resins, such as phthalic anhydride-glycerol resins, maleic acid-glycerol resins, adipic acid-glycerol resins, and phthalic anhydride-pentaerythritol resins; allylic resins, in which such monomers as diallyl phthalate, diallyl isophthalate diallyl maleate, and diallyl chlorendate serve as nonvolatile cross-linking agents in polyester compounds; amino resins, such as aniline-formaldehyde resins, ethylene urea-formaldehyde resins, dicyandiamide-formaldehyde resins, melamine-formaldehyde resins, sulfonamide-formaldehyde resins, and urea-formaldehyde resins; epoxy resins, such as cross-linked epichlorohydrin-bisphenol A resins; phenolic resins, such as phenol-formaldehyde resins, including Novolacs and resols; polyesters such as saturated and unsaturated polyesters; silicones; and urethanes such as polyurethanes and polyurethane elastomerics; and mixtures thereof.

The term "thermoplastic polymer" is used herein to mean any polymer which softens and flows when heated; such a polymer may be heated and softened a number of times without suffering any basic alteration in characteristics, provided heating is below the decomposition temperature of the polymer. Examples of thermoplastic polymers include, by way of illustration only, end-capped polyacetals, such as poly(oxymethylene) or polyformaldehyde, poly(trichloroacetaldehyde), poly(n-valeraldehyde), poly(acetaldehyde), and poly(propionaldehyde); acrylic polymers, such as polyacrylamide, poly (acrylic acid), poly(methacrylic acid), poly(ethyl acrylate), and poly(methyl methacrylate); fluorocarbon polymers, such as poly(tetrafluoroethylene), perfluorinated ethylene-propylene copolymers, ethylene-tetrafluoroethylene copolymers, poly(chlorotrifluoroethylene), ethylene-chlorotrifluoroethylene copolymers, poly(vinylidene fluoride), and poly(vinyl fluoride); polyamides, such as poly(6-aminocaproic acid) or poly(e-caprolactam), poly(hexamethylene adipamide), poly (hexamethylene sebacamide), and poly(11-aminoundecanoic acid); polyaramides, such as poly(imino-1,3-phenyleneiminoisophthaloyl) or poly(m-phenylene isophthalamide); parylenes, such as poly-p-xylylene and poly(chloro-p-xylylene); polyaryl ethers, such as poly(oxy-2,6-dimethyl-1,4-phenylene) or poly(p-phenylene oxide); polyaryl sulfones, such as poly(oxy-1,4-phenylenesulfonyl-1,4-phenyleneoxy-1,4-phenylene-isopropylidene-1,4-phenylene) and poly(sulfonyl-1,4-phenyleneoxy-1,4-phenylenesulfonyl-4,4'-biphenylene); polycarbonates, such as poly(bisphenol A) or poly (carbonyldioxy-1,4-phenyleneisopropylidene-1,4-phenylene); polyesters, such as poly(ethylene terephthalate), poly(tetramethylene terephthalate), and poly-(cyclohexylene-1,4-dimethylene terephthalate) or poly(oxymethylene-1,4-cyclo-hexylenemethyleneoxyterephthaloyl); polyaryl sulfides, such as poly(p-phenylene sulfide) or poly(thio-1,4-phenylene); polyimides, such as poly(pyromellitimido-1,4-phenylene); polyolefins, such as polyethylene, polypropylene, poly(1-butene), poly(2-butene), poly(1-pentene), poly (2-pentene), poly(3-methyl-1-pentene), and poly(4-methyl-1-pentene); vinyl polymers, such as poly(vinyl acetate), poly (vinylidene chloride), and poly(vinyl chloride); diene polymers, such as 1,2-poly-1,3-butadiene, 1,4-poly-1,3-butadiene, polyisoprene, and polychloroprene; polystyrenes; copolymers of the foregoing, such as acrylonitrile-butadiene-styrene (ABS) copolymers; polybutane; polymethyldentene; ethylenepropylene co-polymers, polyamides; tetrablock polymers; styrenic block copolymers; Santoprene®; polyhexamethylene adipamide; poly-(oc-caproamide); polyhexamethylenesebacamide; polyvinyls; polytrifluorochloroethylene; ethylene vinyl acetate polymers; polyetheresters; polyacetate; cellulose acetate butyrate; ethylene/methacrylic acid copolymers; polyamide elastomeric; and polyamides; and mixtures thereof.

In general, the term "cellulosic fibers" is meant to include cellulosic fibers from any source. Sources of cellulosic fibers include, by way of illustration only, woods, such as softwoods and hardwoods; straws and grasses, such as rice and rice hulls, esparto, wheat, rye, and sabai; bamboos; jute; flax; kenaf; cannabis; linen; ramie; abaca; sisal; and cotton and cotton linters; sawdust; newspapers; alfalfa; wheat; wood chips; wood fibers; wood particles; ground wood; wood flour; wood flakes; wood veneers; wood laminates; paper; cardboard; straw; coconut shells; peanut shells; plant fibers; bamboo fiber; palm fiber; cloth; and other similar materials; or mixtures thereof. Softwoods and hardwoods are the more commonly used sources of cellulosic fibers. In addition, the cellulosic fibers may be obtained by any of the commonly used pulping processes, such as mechanical, chemimechanical, semichemical, and chemical processes. For example, softwood and hardwood Kraft pulps are desirable for toughness and tear strength, but other pulps, such as recycled fibers, sulfite pulp, and the like may be used, depending upon the application.

Suitable composite materials include, but not limited to, fiberglass, polyester and epoxy resins, carbon fiber, and Kevlar®.

Suitable metal materials include alloys or pure metals made from steel, aluminum, bronze, copper, nickel, tin or iron, or mixtures thereof. In one embodiment, the metal is stainless steel.

Referring now to FIG. 2, the shield 14 and the attachment arm 18 comprise one embodiment of the light housing 10 of the present invention. The shield 14 and the attachment arm 18 may be manufactured as a single integral member with the shield 14 or the attachment arm 18 can be formed as a separate unit that is attached to the shield 14 in a separate step.

The attachment arm 18 can be made from the same materials or different materials than the shield 14. If made from plastic materials, the shield 14 and/or the attachment arm 18 may be fabricated by extrusion processes known in the art or by such molding techniques as injection molding, compression molding, blow molding, roto-molding, extrusion blow molding or by casting means, etc. If made from metal materials, on the other hand, the shield 14 and/or the attachment arm 18 may be produced by stamping, deep-drawing, hydroforming, bulging, roll-forming, sintering, casting, etc.

In other embodiments, the inside of the rear wall 24 that is immediately adjacent the interior portion 20 may be covered with a reflective material or may be polished so as to more effectively serve as a reflector. In still other embodiments, the reflective material may be a reflector, which includes a reflector body having an outer surface and an inner surface. The outer surface comprises a conventional reflective surface, which reflects light emitted by light source 12 in a conventional manner. The reflective material can include, among others, such materials as glass mirrors, metal or foil. Aluminum alloy sheet material can be used as a reflective material in the present invention because of its ability to maintain a high degree of brightness during use, its formability, and its low weight. Metal reflectors are typically buffed, chemically brightened, and/or anodized to improve their resistance to corrosion.

In still further embodiments, the rear wall 24 may be provided with optional louvers in order to permit part of the light emanating from the light source 12 to pass through the rear wall at an angle thereby not causing any annoyance to the eyes of an observer. The louvers may be simple horizontal or vertical slits or the louvers may be an opening in the rear wall 24 that is shaped as a decorative design. In one embodiment, the louvers are designed as holiday-specific designs so that when light passes through the louver openings, an observer sees a visible illuminated design. For example, the louvers may be designed in the shape of a Jack-O-Lantern for Halloween, Christmas trees for Christmas, or rabbits for Easter.

In still other embodiments, the shield 14 may have indicia imprinted on its surface. The indicia may be writing or may be a decorative design. Suitable decorative designs for the indicia of the present invention include a floral, plant, or a holiday-specific design such as a Jack-O-Lantern, Christmas tree, or Easter eggs.

In a particular embodiment, shown in FIG. 5, the rear wall 24 may be provided with optional louvers 30 in order to permit part of the light emanating from the light source 12 to pass through the rear wall at an angle thereby not causing any annoyance to the eyes of an observer. The louvers 30 may be simple horizontal or vertical slits or the louvers may be an opening in the rear wall 24 that is shaped as a decorative design. In one embodiment, the louvers are designed as holiday-specific designs so that when light passes through the louver openings, an observer sees a visible illuminated design. For example, the louvers may be designed in the shape of a Jack-O-Lantern for Halloween, Christmas trees for Christmas, or rabbits for Easter.

The wings may be of any suitable shape or design that function to at least partially block the visibility of the components of the light source, in addition to what is already blocked by the shield 14. The appendages or wing structures may also have a reflective coating, a reflective surface or reflective component attached thereto as described for the rear wall above. The reflective coating or reflective component can be on either side of the wing structure, but in preferred embodiments, it is located on the inside of the wings, which is the side of the wings facing the shield 14. The appendages or wing structures may also have decorative indicia or decorative louvers as described above for the rear wall.

It should be apparent given the embodiments described herein that the shield 14 could be formed with an infinite number of shapes and sizes, including decorative shapes and sizes. It could also be one color or multicolored. For example, in one embodiment, the shield 14 is a semi-circular design that has an opaque green color and has two sharpened round metal stakes that are attached to and extend below a semi-circular curved rear wall 24 of the shield 14 and has an aperture 28 that is an arch-shaped opening in the rear wall 24 that is open and continuous with the bottom of the shield and has a top 22 that extends from the rear wall 24 to the ends of two semi-circular curved side walls 26. In this embodiment, the two semi-circular curved side walls 26 extend from the semi-circular curved rear wall 24 at the same circumference as the semi-circular curved rear wall 24 so that the two curved side walls 26 are contiguous with the curved shape of the rear wall 24 and form a uniform semi-circular shape.

In one embodiment, the present invention is directed to a light housing for at least partially shielding a light source from a viewer, comprising a shield having a rear wall located between the light source and the viewer, wherein the rear wall has a top edge and a bottom edge, and is formed to partially enclose the light source; a top that is attached to the top edge and at least partially covers that portion of the shield which encloses the light source; and at least one attachment arm for attaching the shield to a fixed object. Optionally, the shield is free of permanent attachment to the light source (i.e. the shield is not directly attached to the light source or any of the light source's components).

In still other embodiments, the present invention is directed to a novel housing for a light source, comprising a shield having an interior portion, a top, a semi-circular rear wall, and two curved sidewalls, wherein the curved sidewalls extend from the semi-circular rear wall at substantially the same radius as the semi-circular rear wall so that the two curved sidewalls are contiguous with the semi-circular rear wall and together form a uniform semi-circular shape, an arch-shaped aperture in the rear wall of the shield for removably inserting the light source, wherein the arch-shaped aperture is open and contiguous with the lower portion of the rear wall, and at least one attachment arm, wherein the at least one attachment arm comprises two round metal stakes, the metal stakes being connected to and extending below the semi-circular rear wall of the shield and function to secure the shield by inserting the stakes into the ground in close proximity to the light source, wherein the shield may touch or contact the light source, but the shield is not directly attached to the light source.

Methods are also provided for at least partially shielding a light source from a viewer comprising providing a shield having a rear wall located between the light source and the viewer, wherein the rear wall has a top edge and a bottom edge, and is formed to partially enclose the light source, an optional top that is attached to the top edge and at least partially covers that portion of the shield which encloses the light source, and at least one attachment arm.

Still other methods are provided for shielding a light source from a viewer comprising providing a shield having a rear wall located between the light source and the viewer, wherein the rear wall has a top edge and a bottom edge, and is formed to partially enclose the light source, a top that is attached to the top edge and at least partially covers that portion of the shield which encloses the light source, and at least one attachment arm, wherein the attachment arm does not attach the shield to the light source.

All references cited in this specification, including without limitation all papers, publications, patents, patent applications, presentations, texts, reports, manuscripts, brochures, books, internet postings, journal articles, periodicals, and the like, are hereby incorporated by reference into this specification in their entireties. The discussion of the references herein is intended merely to summarize the assertions made by their authors and no admission is made that any reference constitutes prior art. Applicants reserve the right to challenge the accuracy and pertinency of the cited references.

In view of the above, it will be seen that the several advantages of the invention are achieved and other advantageous results obtained.

As various changes could be made in the above methods and compositions without departing from the scope of the invention, it is intended that all matter contained in the above description shall be interpreted as illustrative and not in a limiting sense.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims. Therefore, the spirit and scope of the appended claims should not be limited to the description of the preferred versions contained therein.

What is claimed is:

1. A light housing for at least partially shielding a light source from a viewer, comprising:

a) a light source;

b) a shield having a rear wall located between the light source and the viewer, wherein the rear wall has a top edge and a bottom edge, and is formed to partially enclose the light source;

c) at least one attachment arm connected to said shield for attaching the shield to a fixed object; and d) an aperture in the rear wall of the shield, wherein the aperture is contiguous with the bottom edge of the rear wall and wherein a rear portion of the light source is positioned within the aperture.

2. The light housing according to claim 1 comprising at least two attachment arms.

3. The light housing according to claim 1, wherein the rear wall has a semi-circular shape.

4. The light housing according to claim 1, wherein the shield further comprises at least one sidewall.

5. The light housing according to claim 4, further comprising two sidewalls, wherein the two sidewalls are curved and the rear wall has a semi-circular shape.

6. The light housing according to claim 5, wherein the curved sidewalls extend from the semi-circular rear wall at substantially the same radius as the semi-circular rear wall so that the two curved sidewalls are contiguous with the semi-circular rear wall and together form a uniform semi-circular shape.

7. The light housing according to claim 1, wherein the aperture is arch-shaped.

8. The light housing according to claim 1, wherein the shield further comprises a top that is attached to the top edge and at least partially covers that portion of the shield, which encloses the light source.

9. The light housing according to claim 1, wherein the at least one attachment arm is attached to the shield at the bottom edge of the rear wall.

10. The light housing according to claim 1, wherein the at least one attachment arm is injection molded as a unitary construction contiguous with the shield.

11. The light housing according to claim 1, wherein the at least one attachment arm comprises one or more devices selected from the group consisting of glue, screws, clamps, staples, nails, stakes, screws, clamps, tie downs, Velcro®, tape, wire ties, buttons, snaps, weights, hooks, metal rods, or magnetic attachments.

12. The light housing according to claim 1, wherein the attachment arm comprises at least one stake.

13. The light housing according to claim 1, wherein the at least one attachment arm is made from a material selected from the group consisting of steel, stainless steel, aluminum alloys, iron alloys, thermoplastic polymers, thermoset polymers, and cellulosic materials.

14. The light housing according to claim 1, wherein the rear wall is constructed from a material selected from the group consisting of metal, plastic, composite material, and cellulosic material.

15. The light housing according to claim 1, wherein the rear wall comprises a reflective material.

16. The light housing according to claim 1, wherein the light source comprises an in-ground floodlight.

17. A light housing for at least partially shielding a light source from a viewer, comprising:

a) a light source;

b) a shield having a rear wall located between the light source and the viewer, wherein the rear wall has a top edge and a bottom edge, and is formed to partially enclose the light source;

c) a top that is attached to the top edge and at least partially covers that portion of the shield which encloses the light source;

d) an arch-shaped aperture in the rear wall of the shield for removably inserting the light source, wherein the arch-shaped aperture is open and contiguous with the bottom edge of the rear wall; and e) at least one attachment arm, wherein the attachment arm comprises two round metal stakes, the metal stakes being connected to and extending below the semi-circular rear wall of the shield and function to secure the shield by inserting the stakes into the ground in close proximity to the light source.

* * * * *